United States Patent [19]

Kadien

[11] Patent Number: 5,071,007

[45] Date of Patent: Dec. 10, 1991

[54] PAPER BAG AND CARRIER CARD FOR HOLDING CUPS

[75] Inventor: Thomas G. Kadien, Germantown, Tenn.

[73] Assignee: International Paper Company, Purchase, N.Y.

[21] Appl. No.: 378,668

[22] Filed: Jul. 12, 1989

[51] Int. Cl.[5] ..... B65B 85/62

[52] U.S. Cl. ..... 206/429; 206/434; 229/127

[58] Field of Search ..... 206/429, 434, 427, 426, 206/194; 229/127, 40

[56] References Cited

U.S. PATENT DOCUMENTS

| | | | |
|---|---|---|---|
| 930,890 | 8/1909 | Ward . | |
| 948,524 | 2/1910 | Reid . | |
| 1,139,128 | 5/1915 | Lindberg . | |
| 1,158,349 | 10/1915 | Whalen . | |
| 1,343,252 | 6/1920 | Downing . | |
| 1,349,535 | 8/1920 | Smith . | |
| 1,456,897 | 4/1920 | McGrath . | |
| 1,628,718 | 8/1926 | Fritzsche . | |
| 1,983,418 | 12/1934 | Thurmer . | |
| 2,089,297 | 10/1937 | Read . | |
| 2,238,545 | 4/1941 | Whiley | 206/427 |
| 2,459,921 | 1/1949 | Comer | 220/22 |
| 2,657,726 | 11/1953 | Silverman . | |
| 2,761,785 | 9/1956 | Steger . | |
| 2,828,047 | 3/1958 | Weiselberg . | |
| 3,256,983 | 6/1966 | Lech | 229/127 |
| 3,327,924 | 6/1967 | Brutting . | |
| 3,366,305 | 1/1968 | Cohen . | |
| 3,497,057 | 2/1970 | Traner . | |
| 3,840,171 | 10/1974 | Waters . | |
| 3,868,140 | 2/1975 | Gordon | 206/427 |
| 3,884,353 | 5/1975 | Forte | 206/429 |
| 4,114,760 | 9/1978 | Entenmann . | |
| 4,196,807 | 4/1980 | Brom | 206/427 |
| 4,381,057 | 4/1983 | Carver | 206/434 |
| 4,416,411 | 11/1983 | Desmond et al. | 206/427 |
| 4,703,856 | 11/1987 | Chaussadas | 206/429 |
| 4,708,248 | 11/1987 | Davis . | |
| 4,869,599 | 7/1990 | Allen | 206/427 X |

FOREIGN PATENT DOCUMENTS

| | | | |
|---|---|---|---|
| 1268836 | 3/1972 | United Kingdom | 206/434 |

*Primary Examiner*—Paul T. Sewell
*Assistant Examiner*—Jacob K. Ackun, Jr.

[57] ABSTRACT

A cup holder for use in combination with a paper bag. The cup holder is fashioned from a unitary blank of paperboard provided with a plurality of transversely extending fold lines. The blank is folded so as to assume the configuration of a tube open at both ends, with the free ends of the blank being glued together and projecting radially inwardly of the open tube. Two panels of the blank are each provided with an elliptical opening for receiving a cup. In use, the folded and glued blank is inserted into the open end of a conventional paperbag, so that the bottom of the holder is in surface contact with the bottom of the bag. Filled cups of a potable liquid, for example, are then each placed in its respective opening of the holder. The holder and the bag cooperate to rigidify the holder and define an easily carryable assembly.

7 Claims, 2 Drawing Sheets

PAPER BAG AND CARRIER CARD FOR HOLDING CUPS

BACKGROUND OF THE INVENTION

This invention relates to a holder for carrying cups, such as cups of soft drinks or other portable beverages as are served at fast food outlets. Present beverage cup carriers often require a considerable amount of heavy caliper paperboard, which often must be specially treated to resist the effects of moisture. This moisture may be due to spillage or may be due to the inherent moisture content of a cold or hot beverage cup. Further, such holders require a considerable amount of rigidity.

This art is aware of cup carrier or holder constructions employing paperboard which are provided with apertures and are used to hold or carry cups. However, no one of these constructions is entirely suitable as regards cost of manufacture, rigidity, and ease of carrying.

SUMMARY OF THE INVENTION

According to the practice of this invention, a cup carrier or holder is formed from a single blank of paperboard provided with a plurality of apertures for receiving two or more cups and then erected or set up. The holder is used in combination with a conventional paper bag. The holder functions to maintain the cups in upright position while the paper bag functions to provide not only rigidity to the holder, as well as providing an easy means of carrying the cups. The present invention thus exhibits not only simplicity of construction, but is very attractive from a cost point of view because only readily available, inexpensive materials are required.

DETAILED DESCRIPTION OF THE INVENTION

Figure 1:
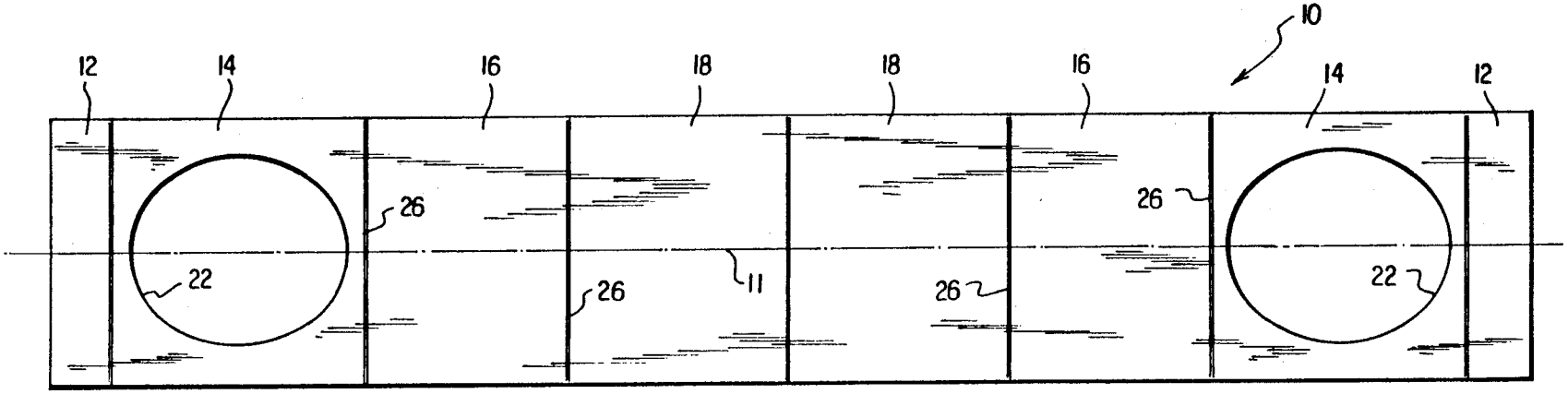
FIG. 1 is a plan view of a blank from which the holder of this invention is fashioned.

Referring now to FIG. 1 of the drawings, the numeral 10 denotes a unitary blank of paperboard or other stiff, resilient and foldable sheet material from which the holder of this invention is formed. The central longitudinal axes of the blank is denoted by the numeral 11. The blank includes a plurality of serially arranged panels, the panels separated from each other and defined by a plurality of transversely extending score or fold lines. The numeral 12 denotes either of the two endmost or free end panels of the blank, each of these panels being adjacent to a top forming panel 14. Side wall forming panel 16 are next to panels 14, with panels 18 denoting bottom forming panel. Each top forming panel 14 is provided with an elliptical opening or aperture 22, which may be die cut through the paperboard. The numeral 26 denotes any one of the transversely extending fold lines which define the serially arranged panels. It will be observed that, in a preferred embodiment, the longitudinally extent, as measured along axis 11, of the two top forming panels 14 is greater than the similar extent of bottom forming panels 18.

Figure 2:
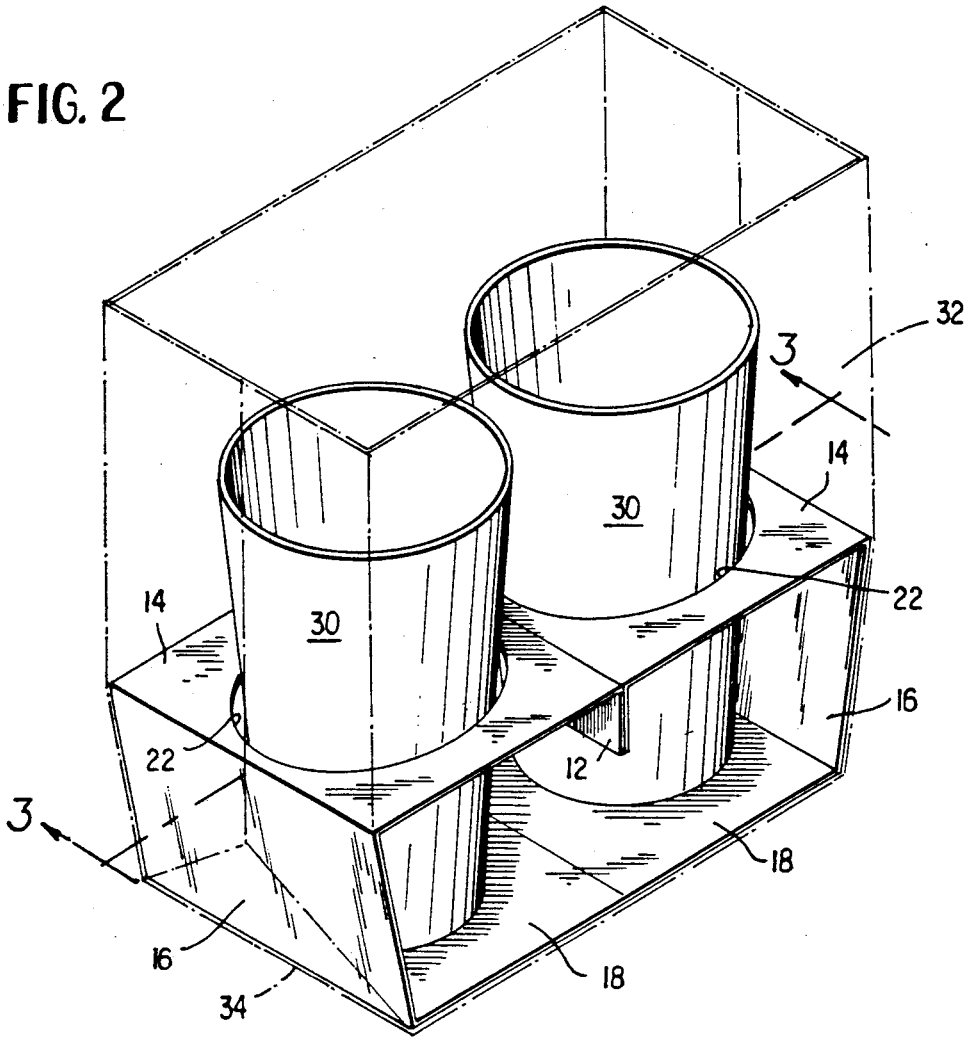
FIG. 2 is a perspective view illustrating the blank of FIG. 1 assembled to form a holder, FIG. 2 also indicating the relationship between the holder of this invention and a conventional paper bag.

Referring now to FIG. 2 of the drawings, the blank is shown after having been folded along the transversely extending fold lines or fold axes 26, with the endmost flaps 12 glued together and forming a stiffening laminate at right angles to top panels 14. The rib defined by the glued together panels 12 may extend radially outwardly, instead of radially inwardly as shown. The resultant structure is of the tube type and has two top panels 14, two side wall panels 16, and a bottom panel defined by two panels 18. Panels 18 may be a single panel instead of the two illustrated by omitting the fold line between them. The holder is illustrated as receiving two cups 30, each cup fitting within a respective elliptical opening 22 with the bottom of each cup resting on a respective bottom panel 18. It will be observed that the length of the top of the holder, defined by panels 14, is greater than the length of the bottom of the holder defined by bottom panel 18. This yields a tapered construction. The holder and cups 30 are shown in combination with a paper bag 32, the latter indicated in phantom lines.

In use, the operator or server at a fast food outlet for example places the holder to a paper bag, such as paper bag 32, with the bottom of the holder in surface contact with the bottom 34 of the paper bag. Then, beverage filled cups 30 are placed in the holder and are maintained in the illustrated upright position. The purchaser then may easily carry the cups by simply grasping the upper edges of the paper bag.

Figure 4:
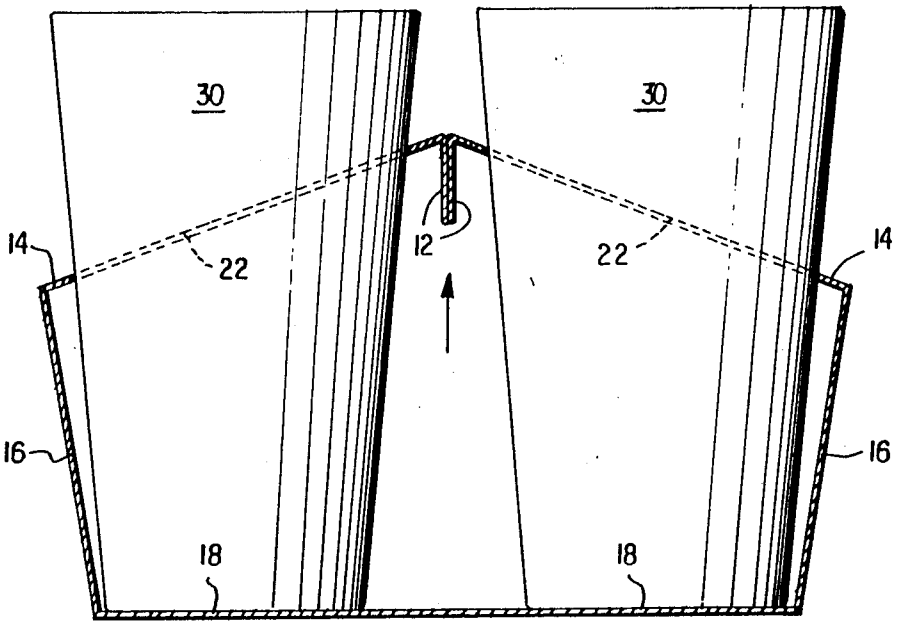
FIG. 4 is a view similar to FIG. 3 and illustrates an optical wedging action on the sides of the cups.
Figure 3:
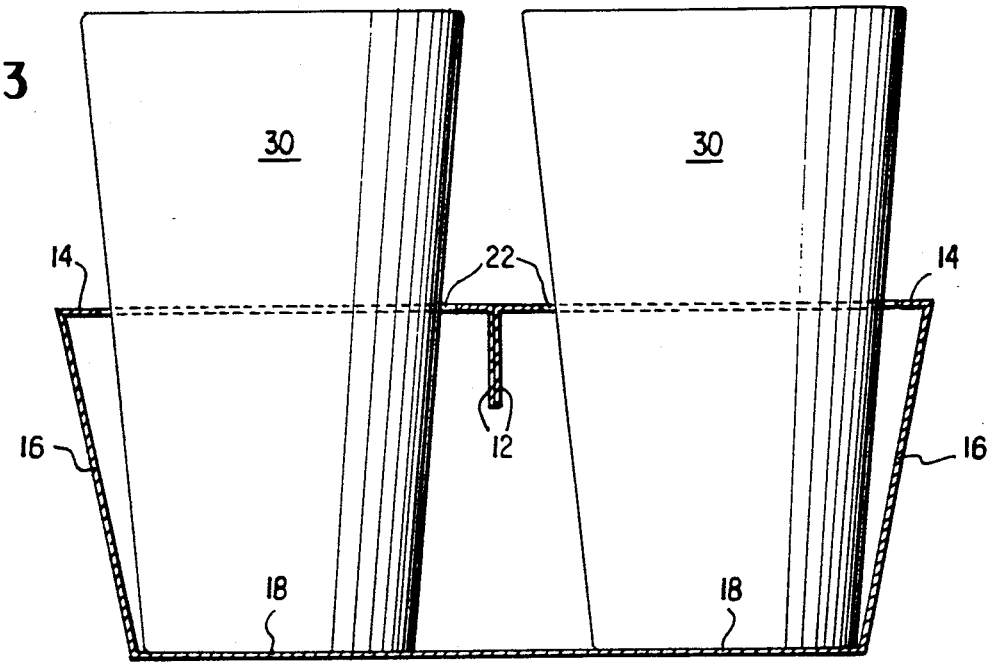
FIG. 3 is a view taken along section 3-3 of FIG. 2 with the cups, however, not shown in section.

To further increase contact between the edge of an opening 22 and a cup therein, the operator at the retail outlet may pull the ends of the rib defined by glued and abutting free end panels 12 upwardly, as indicated at FIG. 4, so that the longer diameter portions (adjacent axis 11 of FIG. 1) of the openings also engage the cup sides. FIG. 4 illustrates the effective removal of the clearance between the longer diameter edges of an opening 22 and the outside surface of a cup 30, this clearance appearing at FIGS. 2 and 3.

In order to firmly anchor and accommodate cups 30, openings 22 are elliptical so that there will be frictional contact between the periphery of an opening 22 and the outer (circular) surface of a respective cup 30 where the cup surface intersects the plane. Due to this frictional engagement, the top panels will tend to tilt downwardly upon cup insertion. The elliptical form of openings 22 is not completely necessary, namely, the openings may be circular.

FIG. 2 illustrates the holder of this invention as holding two cups. However, the length of the top and bottom forming panels may be extended, along axis 11 (see FIG. 1) so as to provide for more than one opening. Further, the top panels 14 may each be provided with more than a single opening 22, in the event very narrow cups are to be packaged.

It will be observed that the bottom of the holder covers the bottom or floor of the bag, thereby affording additional protection from moisture or other damage. Further, the indicated taper may be reversed so that the bottom of the holder is longer than the combined lengths, along axis 11, of top forming panels 14. Preferably, the holder and paper bag are so sized relative to each other that there is a snug fit between them, with the ends of rib forming panels 12 abutting the sides of the bag to further rigidify the complete assembly.

This invention permits the use of graphics on the paper bags while doing away with the need for graphics on the folded paperboard holder itself. Additionally, it lowers the cost of packaging carry-out drinks while requiring less storage volume than many conventional holders, since it can be folded flat prior to erection.

The paperboard from which the blank 10 is formed may be SBS, SUS, MCCN, chip, or other grades.

I claim:

1. A holder for holding a plurality of cups, said holder fashioned from a unitary blank of paperboard or other stiff, resilient and foldable sheet material, said holder being in the general form of a tube open at both ends and having a bottom wall, two side walls, and two top walls, the top walls each provided with an opening adapted to receive a respective cup, the top walls being joined by an end flap integral with each top wall, said flaps being glued together and extending at right angles to a respective top wall and forming a rib, the rib being movable upwardly with respect to the bottom wall to change the position of the top walls and thus cause the periphery of each opening to snugly engage cups adapted to be placed in the openings.

2. The holder of claim 1 wherein said glued together end flaps extend radially inwardly of the open tube and wherein said top walls are coplanar.

3. The holder of claim 1 wherein the length of the top walls is greater than the length of the bottom wall, whereby the holder is tapered from its bottom wall to its top walls.

4. The holder of claim 1 in combination with a paper bag, the bottom wall of the holder contacting the bottom of the paper bag, the ends of the rib engaging opposite sides of the paper bag, the holder fitting snugly in the bag.

5. The holder of claim 1 where at least one of said openings is circular.

6. The holder of claim 1 where at least one said openings is elliptical.

7. The holder of claim 1 where the rib is spaced from the bottom wall.

* * * * *